US005354641A

United States Patent [19]

Lima-Marques

[11] Patent Number: 5,354,641

[45] Date of Patent: Oct. 11, 1994

[54] METHOD AND APPARATUS FOR TRANSFER OF TONER DEPOSITED ON IMAGE AREAS OF A RECORD CARRIER

[75] Inventor: Luis Lima-Marques, Darlington, Australia

[73] Assignee: MAN Roland Druckmaschinen AG, Offenbach am Main, Fed. Rep. of Germany

[21] Appl. No.: 861,932

[22] Filed: Apr. 2, 1992

[30] Foreign Application Priority Data

Apr. 10, 1991 [AU] Australia ..... PK5560

[51] Int. Cl.[5] ..... G03G 13/14

[52] U.S. Cl. ..... 430/126; 430/137

[58] Field of Search ..... 430/126, 137

[56] References Cited

U.S. PATENT DOCUMENTS 5,213,931 5/1993 Staples et al. ..... 430/102

FOREIGN PATENT DOCUMENTS 3911932 10/1990 Fed. Rep. of Germany .
58-44472 3/1983 Japan .
1107395 3/1968 United Kingdom .

*Primary Examiner*—John Kight, III
*Assistant Examiner*—Richard Jones
*Attorney, Agent, or Firm*—Frishauf, Holtz, Goodman & Woodward

[57] ABSTRACT

To permit transfer of toner particles forming an image from a ferroelectric surface (2) onto a substrate (6), without careful operating constraints, an intermediate or offset cylinder (4, 11) is placed opposite the ferroelectric surface (2) to define a small gap (16) therewith, in the order of between about 0.05 to 0.15 mm. The surface on the offset member, preferably a cylinder, can be either semiconductive or insulating material (5), typically very smooth polyurethane, or a conductive sleeve (14) over an insulating core. The substrate (6) is engaged against the offset cylinder (4, 11) by an impression or counter or transfer roller (7) which is subjected to a high direct current voltage, for example between about 1 kV to 4 kV. Corona elements (24, 23) can be located close to the ferroelectric surface and to the offset cylinder surface, the electrode being energized with reverse polarity to assist in a transfer of toner particles to the intermediate or offset cylinder (4, 11).

15 Claims, 1 Drawing Sheet

METHOD AND APPARATUS FOR TRANSFER OF TONER DEPOSITED ON IMAGE AREAS OF A RECORD CARRIER

Reference to related application, assigned to the assignee of the present application U.S. Ser. No. 07/697,106, filed May 8, 1991, Staples et al.

BACKGROUND

Electrostatic printing is a well known printing process in which an electrostatic latent image is made to attract electrostatic marking particles, that is, a toner. The toner can be of the dry type or of the liquid type. Electrostatic printing is particularly applicable when only a relatively small number of prints are required, or when the subject matter is frequently changed, or when part of the subject matter needs to be sequentially changed.

Dry powder toners have many disadvantages when used in such a process. The main objection is related to the dusting problem. Dust, or fine, or small particles of toner are prone to escape from the developer, and these deposit onto any surface both within and outside the printing device, causing mechanical failures within the device and environmental problems outside the device. This problem becomes severe when such printing devices are run at high speed. Other disadvantages include cost of the general maintenance of the press and cost of the dry powder toner.

Liquid electrostatic printing also has a number of objectionable problems, especially when these devices are required to operate at high speed. The main problem is in regard to the solvent carry-out. The term solvent carry-out relates to the quantity of solvent or carrier which is trapped within the paper and mechanically removed from the toner applicator. Such solvent subsequently evaporates, giving rise to atmospheric pollution and also adding significantly to production costs. A further disadvantage of liquid toning is the tendency for deposition of coloring matter in non-image or background areas which results in a general discoloration of the copy, normally referred to as background fog.

It has previously been found that in those instances in which the printing master consists of a ferroelectric recording member having a more or less permanent latent image impressed on or about its surface by way of internal polarization, the liquid dispersed toner may be caused to contact the printing master in the image areas only, thus eliminating background fog and substantially reducing solvent carry-out. This is disclosed in U.S. patent application Ser. No. 07/697,106, filed May 8, 1991, Staples et al.

The meniscus toning method of the referenced application Ser. No. 07/697,106 results in a substantial reduction in solvent carry-out and elimination of background fog under carefully controlled conditions.

THE INVENTION

It is an object to improve the method of the referenced application Ser. No. 07/697,106, assigned to the assignee of the present application, such that less stringent control of toning conditions can be tolerated, by using a modified transfer technique.

Briefly, toner is deposited on the latent image contained on or about the surface of a ferroelectric recording member, typically a cylinder. The toner is then transferred, by inductive transfer, from the recording member surface to an intermediate or offset member, typically a cylinder, with subsequent transfer of the toner deposit from the surface of the intermediate or offset member to a receiving element, such as a substrate in form of a web or sheets, for example of paper. The second transfer from the offset member to the substrate may use conventional electrostatic transfer technology.

In accordance with a feature of the invention, the intermediate member or cylinder is preferably coated with a resilient layer of a material which is semiconductive or insulating, and on which a surface charge is impressed by application of a d-c voltage to a transfer roller; the transfer roller may, at the same time, form a counter or impression cylinder which holds the substrate in contact with the surface of the intermediate or offset member. A gap is provided between the intermediate member and the surface of the recording member, so that the surfaces do not touch.

In accordance with another feature of the invention, the intermediate or offset member may be a metal cylinder, or an insulating cylinder with a metal sleeve.

In accordance with another feature of the invention, the offset transfer or toner is deposited on the image area of the surface of the recording member by carrying out the following steps: The recording member is formed as a cylinder, which is rotating, and on the surface of which image areas are located having toner applied thereto. The offset member, typically a cylinder, is positioned such that the surface of the offset member, preferably a cylinder, is slightly spaced from the surface of the recording member, to form a gap. The members rotate at the same peripheral speed. The offset member is contacted by the substrate at a position circumferentially spaced from the engagement zone with the recording member. The back side of the substrate is contacted by an impression or counter or transfer roller, which presses the substrate against the offset member or cylinder. A direct voltage is applied to the transfer roller which, by electrostatic induction, causes sequential transfer of toner deposit to the offset member surface and then to the surface of the receiving member or element, typically the substrate and usually a paper substrate.

DRAWINGS

FIG. 1 is a highly schematic illustration of a preferred configuration of the transfer system in accordance with the present invention; and FIG. 2 is a fragmentary alternative schematic illustration of the system.

DETAILED DESCRIPTION

Figure 1:
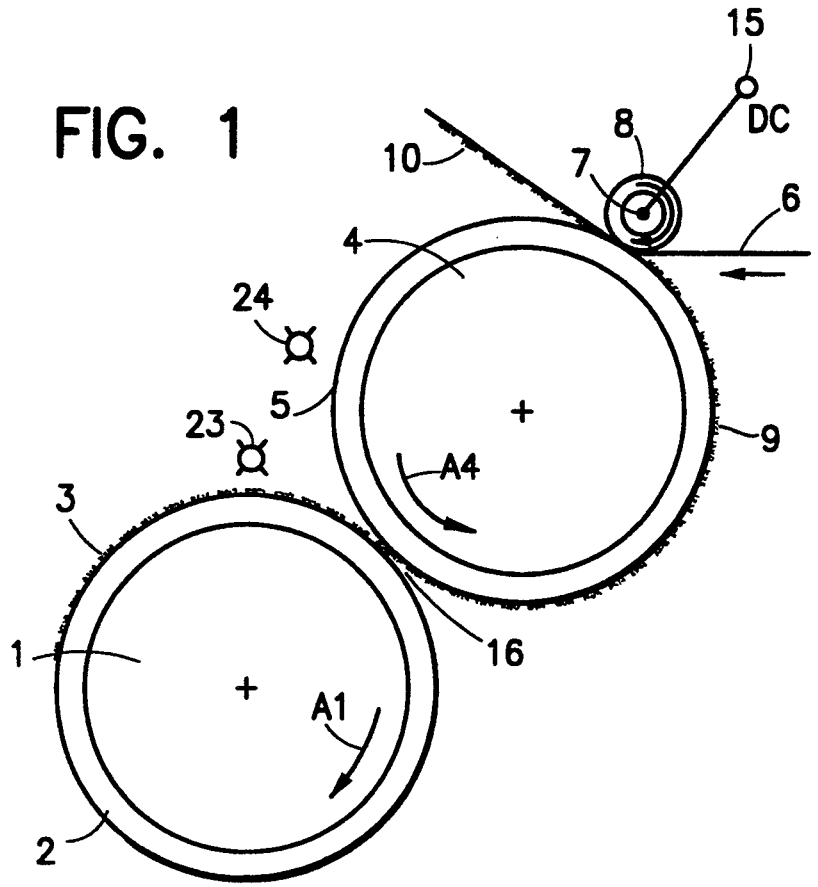

Referring first to FIG. 1:

A cylinder 1 has a recording member or structure 2 on the outer surface thereof. The recording structure or member 2 is a ferroelectric layer. Cylinder 1 is mounted to be rotatable in the direction shown by the arrow A1. The recording member 2 carries toned image deposits 3 on the surface thereof.

In accordance with a feature of the invention, an offset cylinder 4, having a semiconductive or insulating layer 5 on the outer surface thereof, is mounted in spaced-apart relation with respect to cylinder 1, defining a gap 16 therebetween. Cylinder 4 is rotatable in the direction of the arrow A4 at the same peripheral speed as cylinder 1.

A substrate, for example a web or sheet 6, which, typically, is of paper—although other materials may be used—contacts the offset cylinder 4 at a printing line, at the position shown in FIG. 1. Web or sheet 6 is held in such contact by pressure applied by a counter or impression or transfer roller 7. The transfer roller 7 preferably has a resilient conductive or insulating layer 8 at the outer surface thereof. A high d-c voltage is applied to transfer roller 7 by a suitable voltage source, shown only schematically at 15. This voltage induces a voltage on the surface of the offset cylinder 4 by electrostatic induction. This induced voltage will be less than the applied voltage at terminal 15.

Rotation of the various cylinders in the directions shown, and the influence of the d-c voltage as applied, causes transfer of toned image deposit 3 from the recording cylinder 1 to the offset cylinder 4 across the gap 16 to form offset image deposits 9 on the surface of the offset cylinder 4. These offset deposits 9 are subsequently transferred by electrostatic transfer to the substrate 6, which receives the toner, and may be termed a toner receiving member, to form the final image deposits 10 on the substrate 6.

Figure 2:
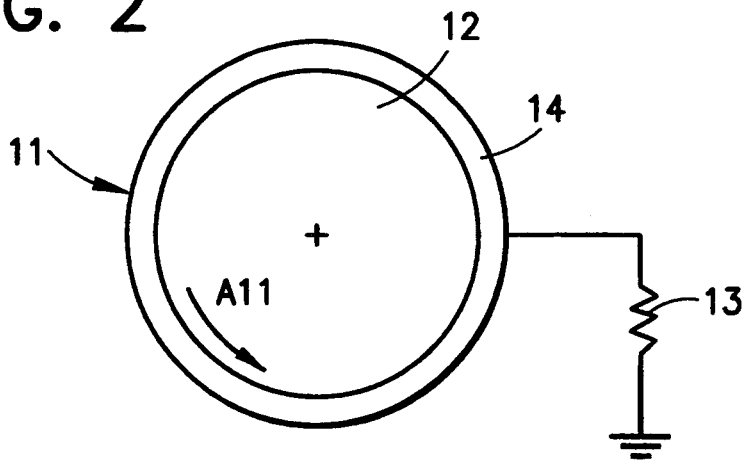

FIG. 2 illustrates and alternative for the offset cylinder 4 of FIG. 1. The offset cylinder 11 has an insulating support 12 with a metal sleeve 14 thereover, rotating in the direction shown by arrow A11. Sleeve 14 is connected to ground through resistor 13.

In a preferred form of the present invention, the recording member 2 is located on the outer surface of the cylinder 1 which rotates, with the gap 16 therebetween , in the same circumferential direction as the offset cylinder 4. Offset cylinder 4, with respect to the substrate 6, may be termed a toner donor member. The intermediate or offset cylinder 4 is located in printing relationship to the substrate 6, which is backed up by the impression roller or cylinder 7. The outer surface of the intermediate cylinder 4 is preferably coated with a resilient layer of semiconductor or insulating material, such as a synthetic rubber or the like. The preferred width of the gap 16 is in the order of about 0.1 mm. It may be more, or less, however, depending on the amount of liquid contained in the toner deposit on the surface of the recording member 1. The drier the toner, the smaller the gap.

The impression roller 7, positioned against the reverse side of the substrate 6, can be located more or less opposite the position of the recording member 1, with respect to the offset cylinder 4. The receiving substrate 6, typically in form of a paper web, passes between the impression roller 7 and the offset roller 4, and is in contact with both of them.

The voltage source 15, preferably, provides a d-c voltage of about 2000 volts, which is applied to the impression roller 7. This voltage impresses a voltage on the surface of the offset cylinder 4 in the order of about 1000 V. This is sufficient to cause inductive transfer of the toner particles from the surface of the recording cylinder 1 to the surface of the offset cylinder 4, even though there is no surface contact between cylinders 1 and 4. Liquid contained on the surface 2 of the recording cylinder 1 is not transferred to the offset cylinder 4, although sufficient liquid remains on the toner deposit for transfer mobility. The higher voltage on the impression roller 7 causes electrostatic transfer of the toner deposit from the intermediate or offset cylinder 4 to the surface of the substrate 6. Non-image, or untoned areas on the substrate 6 remain completely dry, and the quantity of liquid contained in the image deposit as transferred to the receiving member surface is immeasurably small.

The apparatus and process of the present invention has the additional advantage that it is no longer necessary to apply transfer voltages to any member or element which contacts the image bearing surface of the recording member or cylinder 1. This eliminates distortion of the latent image on the surface of the recording cylinder 1.

According to another, and advantageous feature of the invention, the semiconductive or insulating, that is, dielectric layer 5 on the member, typically a cylinder 4, and which surrounds the member 4, is additionally charged by corona charging, as schematically indicated by a corona discharge element 24. In accordance with a further, and preferred embodiment, the toned image deposits 3 on the recording cylinder 1 are also subjected to a corona discharge, which, however, has the opposite polarity to that of the discharge unit 24. The corona discharge element affecting the deposits 3 is shown at 23. The additional charging elements 24, 23 facilitate the transition of toner particles from the image areas of the recording member surface to the surface 5 of the offset cylinder 4.

In the preferred embodiment of the invention, the inductive offset transfer member 4 is used for transfer of toner deposited on the ferroelectric 2 of the recording member 1 in an electrostatic printer. The toner deposit is subsequently transferred using prior art electrostatic transfer technology to the surface of the substrate 6, usually a paper web.

The layer 5 of the offset cylinder 4, FIG. 1, usually is a more or less resilient layer of semiconductor or insulating material. A polyurethane coating is suitable.

EXAMPLE 1

A polyurethane coating 3 mm thick was cast on the outer surface of the cylindrical offset member 4. The polyurethane was characterized by a surface resistivity of $1.7\times10^{11}$ ohms, volume resistivity of $4.7\times10^{10}$ ohm-cm and duro hardness of 49 Shore A.

This offset transfer member 4 was used in an equipment as illustrated in FIG. 1. The printing speed was 0.5 meters/second, and the offset transfer gap 16 was 0.1 mm. Satisfactory offset transfer to the offset member 4 followed by final transfer to a paper web 6 was obtained when a transfer voltage of 2 kV negative was applied at terminal 15 to the transfer roller 7. Under these conditions the voltage measured on the polyurethane surface 5 of the offset member 4 was 1.0 kV negative.

EXAMPLE 2

Example 1 was repeated, with the exception that the printing speed was increased to 1 meter/second. It was found necessary to increase the voltage applied to the transfer roller 7 to 4 kV negative to obtain satisfactory offset and final transfer. Under these conditions the voltage measured on the polyurethane surface of the offset member was 1.5 kV negative.

EXAMPLE 3

Example 1 was repeated at a printing speed of 1 meter/second, but the offset transfer gap 16 was reduced to 0.05 mm. The voltages were as in Example 1. Transfer was of satisfactory quality.

EXAMPLE 4

The polyurethane coating of Example 1 was replaced with another polyurethane coating, characterized by a surface resistivity of $2\times10^{12}$ ohms, volume resistivity of $8\times10^{10}$ ohm-cm, and duro hardness of 80 Shore A. The printing speed, offset transfer gap and applied voltage were as in Example 1. The measured voltage on the offset member was 1.25 kV negative. Offset transfer and final transfer were of satisfactory quality.

EXAMPLE 5

Example 4 was repeated with the printing speed increased to 1 meter/second. The voltage measured on the offset member was reduced to 1 kV negative, however offset transfer and final transfer were still of satisfactory quality.

EXAMPLE 6

Example 5 was repeated, but with the transfer gap 16 increased to 0.15 mm. Satisfactory toner transfer was obtained. The voltage measured on the offset member 4 was slightly higher than in Example 5, namely 1.1 kV negative.

EXAMPLE 7

The examples 1 to 6 can be repeated when a corona electrode 24 is arranged e.g. in a distance of about 15 mm from the offset member 4. The corona electrode has a diameter of 50 μm for example, and is charged by a voltage of 4 kV. The toned image deposits 3 on the cylindrical member 1 are charged in the opposite polarity from electrode 23, similar to electrode 24.

It will be realized that other physical characteristics of the offset member 4 of this first embodiment are also of significance. In particular, the surface topography can have an influence on final print definition. It appears at this stage that ideally the surface of the offset member 4 should show less than 2 microns RMS variation, although acceptable results have been obtained with variation considerably in excess of this, such as 10 microns RMS variation. Such high degree of surface finish can be more easily achieved if the duro hardness of the polyurethane is higher than has been disclosed in Examples 1–3, such as 75–85 Shore A. It also appears that the surface resistivity should ideally be of the order of $10^{11}$ ohm, and volume resistivity within the range $10^{9}$–$10^{10}$ ohm-cm.

The following examples relate to the second embodiment of this invention, in which the outer surface of the offset member 11 is a conductive metal band 14 grounded through resistor 13 as shown in FIG. 2. In each of the following examples the resistance of resistor 13 was 1000 meg ohm.

EXAMPLE 8

A cylindrical offset member 11 with a conductive surface 14 over an insulating core 12 was prepared as in FIG. 2 and used as a replacement for cylinder 4 in the equipment as illustrated in FIG. 1. The printing speed was 0.5 meters/second and the offset transfer gap 16 was 0.1 mm. Satisfactory offset and final transfer were obtained when a transfer voltage of 1.5 kV negative was applied to the transfer roller 7. The voltage measured in the surface 14 of the offset member 11 was 1.0 kV negative.

EXAMPLE 9

Example 8 was repeated at a printing speed of 1 meter/second. The voltage measured on the offset member was 1.1 kV negative.

EXAMPLE 10

Example 9 was repeated using a transfer gap 16 of 0.15 mm. The voltage measured on the offset member 11 was 1.15 kV negative. Once again final print quality was satisfactory.

It will be realized that a d-c voltage can be applied directly to the offset member 11 independently of the voltage applied to the transfer roller 7 if desired, and that successful operation of this present invention does not rely on the use of the voltage divider arrangement described in the foregoing.

It will also be realized that voltages substantially higher than those disclosed herein may be needed at substantially higher printing speeds.

I claim:

1. A method for the transfer of toner deposited on the image area of a ferroelectric recoding surface (2) supported on a recording support member (1), to transfer said toner to a printing substrate (6), said method comprising the steps of positioning an offset member (4, 11) in spaced-apart relationship with respect to the ferroelectric recording surface (2) to define a gap (16) therewith, said ferroelectric recording surface having toned image area deposits (3) thereon;

contacting said offset member (4, 11) with the printing substrate (6) at a position remote from said gap (16), said contacting step including engaging said printing substrate (6) with a charge transfer and impression member (7) at the reverse side of said substrate, with respect to said offset member, and positioned to press said substrate against said offset member (4, 11); and applying a direct current voltage to said transfer and impression member (7) for transfer of said toner deposits (3) from the ferroelectric recording surface (2) of the recording support member (1) to the surface of the offset member (4, 11) for subsequent transfer of said toner deposits to said printing substrate (6).

2. A method for the transfer of toner deposited on the image area of a ferroelectric recording surface (2) positioned on the outer periphery of a cylindrical recording support member (1) for application of toner particles to a printing substrate (6), said method comprising the steps of rotating said cylindrical recording support member (1) with said ferroelectric recording surface (2) thereon, said ferroelectric recording surface having toned image area deposits (3) thereon;

providing a cylindrical offset member (4, 11) and rotating said cylindrical offset member in spaced-apart relationship with respect to the ferroelectric recording surface (2) on the recording support member (1) to define a gap (16) therewith;

said recording support member (1) and said cylindrical offset member (4, 11) rotating at the same peripheral or circumferential speed;

contacting said cylindrical offset member (4, 11) with the printing substrate (6) at a position circumferentially remote from said gap (16);

holding said substrate (6) in contact with said cylindrical offset member (4, 11) by contacting the reverse side of said substrate (6) with an impression or counter or transfer roller (7) positioned to press said substrate against the surface of said cylindrical offset member (4); and applying a direct current voltage to said impression, or counter or transfer roller (7) for sequential transfer of said toner deposits to the surface of said offset member (4, 11) from the ferroelectric recording surface (2) of the recording support member (1) and subsequently to said substrate (6).

3. The method of claim 2, wherein said gap (16) between said recording member surface (2) and said cylindrical offset member (4) at the point of closest approach is between about 0.05 to 0.15 mm.

4. The method of claim 2, wherein the direct current voltage applied to said counter or transfer roller (7) is between about 1 kV to 4 kV.

5. The method of claim 2, wherein said cylindrical offset member (4) has a surface layer (5) of semiconductive or insulating material.

6. The method of claim 5, wherein said surface comprises a layer of polyurethane.

7. The method of claim 6, wherein said polyurethane layer on the surface of the cylindrical offset member (5) has a surface of resistivity within the range $1.7\times10^{11}$ ohms to $2\times10^{12}$ ohms and a volume resistivity within the range $1\times10^{10}$ ohm-cm to $4.7\times10^{10}$ ohm-cm.

8. The method of claim 6, wherein said polyurethane layer on the surface of the cylindrical offset member (4) has a Duro hardness within the range of 49–85 Shore A.

9. The method of claim 2, wherein said cylindrical offset member (4) comprises an insulating cylinder (12) and an outer annular conductive metallic layer (14) on the outer surface thereof.

10. The method of claim 2, further including the step of providing an electrostatic charge to the surface of the cylindrical offset member (4); and providing an electrostatic charge to the toned image deposits (3) of opposite polarity to the charge applied onto the cylindrical offset member.

11. A system for transfer of toner deposited on a ferroelectric recording surface (2) on a cylindrical support member (1), to transfer the toner deposits onto a printing substrate (6), carrying out the method of claim 2, said system comprising an offset cylinder (4) having a conductive cylindrical core and an outer surface of semiconductive or insulating material; and wherein said outer surface (5) is spaced from the ferroelectric recording surface (2) by a small gap (16).

12. The system of claim 11, wherein said semiconductive or insulating layer on the cylindrical offset member comprises polyurethane having surface resistivity within the range $1.7\times10^{11}$ ohms to $2\times10^{12}$ ohms and a volume resistivity within the range $8\times10^{10}$ ohm-cm to $4.7\times10^{10}$ ohm-cm.

13. The system of claim 11, further comprising corona electrode means (24) arranged in the proximity of the cylindrical offset member (4); and means (23) for charging the toned image deposits (3) on the ferroelectric recording member (2).

14. A system for transfer of toner deposited on a ferroelectric recording surface (2) on a cylindrical support member (1), to transfer the toner deposits onto a printing substrate (6), carrying out the method of claim 2, said system comprising an offset cylinder (11) having an essentially insulating core element (12) and an outer cylindrical conductive layer (14); and wherein said outer surface (5) is spaced from the ferroelectric recording surface (2) by a small gap (16).

15. The system of claim 14, further comprising corona electrode means (24) arranged in the proximity of the cylindrical offset member (11); and means (23) for charging the toned image deposits (3) on the ferroelectric recording member (2).

* * * * *